US005946921A

United States Patent [19]

Mapes, III et al.

[11] Patent Number: 5,946,921

[45] **Date of Patent: *Sep. 7, 1999**

[54] METHOD FOR REPAIRING HFC REFRIGERANT SYSTEM

[75] Inventors: William Henry Mapes, III; John Joseph Hellmueller, Jr.; Joseph B. Hofelich, all of Louisville, Ky.

[73] Assignee: General Electric Company, Louisville, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/517,846

[22] Filed: Aug. 22, 1995

[51] Int. Cl.[6] ..... F25B 47/00

[52] U.S. Cl. ..... 62/85; 62/77

[58] Field of Search ..... 62/77, 85, 475, 62/292, 303

[56] References Cited

U.S. PATENT DOCUMENTS

| | | | |
|---|---|---|---|
| 2,341,429 | 2/1944 | Elsey . | |
| 2,341,430 | 2/1944 | Elsey . | |
| 2,551,426 | 5/1951 | Eaker . | |
| 3,025,233 | 3/1962 | Figert | 210/502 |
| 3,175,342 | 3/1965 | Balogh | 55/316 |
| 3,224,167 | 12/1965 | Jones . | |
| 3,841,490 | 10/1974 | Hoffman et al. | 210/266 |
| 3,899,310 | 8/1975 | Chi et al. | 55/71 |
| 4,476,688 | 10/1984 | Goddard | 62/292 |
| 4,554,792 | 11/1985 | Margulefsky et al. | 62/77 |
| 4,805,416 | 2/1989 | Manz et al. | 62/292 |
| 5,021,179 | 6/1991 | Zehler et al. | 252/54.6 |
| 5,211,884 | 5/1993 | Bunemann et al. | 252/56 S |
| 5,247,812 | 9/1993 | Keltner | 62/475 |
| 5,347,822 | 9/1994 | Lavin et al. . | |

FOREIGN PATENT DOCUMENTS

| | | | |
|---|---|---|---|
| 0 406 479 A1 | 9/1991 | European Pat. Off. | 105/38 |

OTHER PUBLICATIONS

Declaration of Joseph B. Hofelich, dated May 5, 1998, 2 pages.

Tecumseh Products Company—Guidelines For Utilization of R134a, 6 pages (Assume published prior to Aug., 1995)—note particularly Section IV C.

*Primary Examiner*—William Doerrler
*Attorney, Agent, or Firm*—H. Neil Houser

[57] ABSTRACT

A combination of a chemical filter and a molecular sieve desiccant dryer are provided in the liquid line of the refrigeration system in a refrigerator which contains a chlorine-free hydrofluorocarbon refrigerant and a hygroscopic polyol ester compressor lubricant after a repair is made to the system and before it is recharged with fresh refrigerant. The chemical filter, such as activated alumina, filters out hydrolysis products of the lubricant and moisture which block the capillary tube, and the dryer removes moisture from system.

18 Claims, 1 Drawing Sheet

METHOD FOR REPAIRING HFC REFRIGERANT SYSTEM

BACKGROUND OF THE INVENTION

1. Field of the Invention

This invention relates to a method for repairing an HFC refrigeration system. More particularly, this invention relates to repairing a sealed refrigeration system in a household refrigerator which contains an HFC refrigerant and a hygroscopic lubricating oil, by making the repair after the refrigerant has been removed, providing an activated alumina filter and molecular sieve dryer in series in the liquid line, removing air from the system and then charging the system with fresh HFC refrigerant.

2. Background of the Disclosure

Hermetically sealed refrigeration systems are used for refrigerators, freezers, home and automotive air conditioners and the like. Such refrigeration systems include a compressor, a condenser and an evaporator, with a liquid refrigerant line containing an expansion device such as a capillary tube, orifice or thermal expansion valve between the condenser and evaporator. Refrigerators and freezers employ a capillary tube as the refrigerant expansion device and they also contain a dryer in the liquid line upstream of the capillary tube. In operation, the compressor compresses the refrigerant vapors which then condense to the liquid state in the condenser and pass through the liquid line and capillary tube into the evaporator. The capillary tube serves as an expansion valve. The refrigerant vaporizes in the evaporator, thereby absorbing its latent heat of evaporation from the surrounding environment, which provides the cooling. A desiccant dryer is frequently employed in the liquid line to absorb any moisture introduced into the system during manufacture, from leaks, and from repairs which open the system to the atmosphere. With refrigerators, freezers and nonautomotive air conditioners, the compressors are designed such that the compressor and electric compressor motor are in the same housing. Consequently, both the refrigerant and lubricating oil have to be miscible with each other and not form separate phases throughout the entire working temperature range of the system (e.g., −20 to +150° F.). This also means that the refrigerant and oil are in contact with the coils of the electric compressor motor and must therefore be electrically insulative.

Typical refrigerants have included chlorofluorocarbons (CFC's), such as trichloromonofluoromethane and dichlorodifluoromethane known in the trade as R-11 and R-12, respectively, and hydrochlorofluorocarbons (HCFC's) such as monochlorodifluoromethane which is known as R-22. Compressor lubricating oils have generally been mineral oils which are hydrocarbon oils derived from petroleum and which are inexpensive, noncorrosive, relatively chemically inert, electrically insulative and hydrophobic. In making repairs to these systems the old refrigerant is removed, new refrigerant introduced and the system resealed. A desiccant dryer present in the liquid line removes moisture from the circulating refrigerant and oil to avoid icing of the capillary or expansion valve and also to avoid the formation of a corrosive mineral acid in the system, such as hydrochloric acid, by reaction of the water with the refrigerant. In the case of a compressor burn-out, polymer, wax, sludge and small amounts of fatty acids are sometimes formed which need to be removed from the system during a repair. When replacing a compressor, both the refrigerant and the lubricating oil in the system are discarded and replaced with a fresh charge. Typical repair procedures, desiccant dryers, and filters containing an adsorbent which have been used external of some systems for cleaning up old refrigerant and introducing the old refrigerant back into the system are well known and disclosed, for example, in U.S. Pat. Nos. 3,025,233; 3,175,342; 3,841,490; 4,554,792, and 5,247,812.

Many countries are prohibiting the use of CFC and HCFC refrigerants, because it is believed that the chlorine in the molecules has been a major factor contributing to the depletion of the ozone layer. Consequently, hydrofluorocarbon (HFC), chlorine-free refrigerants have been developed. These include $CH_3CHF_2$, $C_2HF_5$, $CH_2F_2$, $C_2H_3F_3$, $CHF_3$ and $C_2H_2F_4$ which are commonly known as R-152a, R-125, R-32, R-143a, R-23 and R-134a, respectively. R-134a which is 1,1,1,2-tetrafluoroethane (R-134 is its symmetrical isomer 1,1,2,2-tetrafluoroethane) has been adopted for use by many major manufacturers of refrigeration equipment in the United States. This R-134a refrigerant is not compatible with mineral oils and new synthetic oils have been developed which are very hygroscopic and form organic acids if exposed to moisture. These acids are corrosive and difficult to remove from the system. Some major manufacturers of refrigeration equipment have therefore recommended that once the hermetic seal has been opened, neither the compressor nor the system should be left open to the atmosphere for more than ten to fifteen minutes and that any repairs to the system be completed within this ten to fifteen minute time period. It is difficult to repair a unit within ten to fifteen minutes and not all repairs can be accomplished within this time.

SUMMARY OF THE INVENTION

The present invention relates to a method for repairing a sealed refrigeration system employing a hydrofluorocarbon refrigerant and a hygroscopic compressor lubricant, which method permits the system to be exposed to the atmosphere for a period of time in excess of fifteen minutes and even for periods of time in excess of an hour. This method is based on the use of both a chemical filter and a dryer being placed in the liquid line before the system is charged with fresh refrigerant. Thus, in its broadest sense the invention relates to a method for repairing a sealed refrigeration system containing a hydrofluorocarbon refrigerant and a hygroscopic lubricant in which a combination of a chemical filter and a dryer are provided in the liquid line before the system is charged with fresh hydrofluorocarbon refrigerant and resealed. In another embodiment, the invention relates to an apparatus comprising a sealed refrigeration system having a liquid line and containing a hydrofluorocarbon refrigerant and a hygroscopic lubricant, said system further including a chemical filter and a dryer in said liquid line. In an embodiment in which the sealed refrigeration system includes a compressor, condenser, evaporator and a liquid refrigerant line including a capillary tube between the condenser and compressor, the method comprises removing the old refrigerant, making the necessary repair, providing a chemical filter and a dryer in the liquid line, removing the air and evacuating the system, adding a fresh charge of refrigerant to the evacuated system and then sealing the system. Thus, in this embodiment the invention comprises the steps of:

(a) removing the refrigerant from the system;

(b) making the necessary repair;

(c) providing a chemical filter and a dryer in the liquid line;

(d) removing air and evacuating the system;

(e) adding a charge of new refrigerant to the system, and (f) sealing the system.

In an embodiment in which a dryer is present in the system, this dryer (the old dryer) is preferably removed and discarded before the combination of a chemical filter and a new dryer are placed in the liquid line. However, it is also possible to leave the old dryer in the line and add (i) only the chemical filter or (ii) add both a chemical filter and a new dryer, at the discretion and expertise of the practitioner and based on a diagnosis of the necessary repair and age of the system. Also, after the repair has been made and the system evacuated a purge charge of fresh refrigerant is typically added to the repaired system and circulated throughout the system to remove air and any other entrained impurities. The filter and dryer combination of the invention are provided in the liquid line before evacuation and before any new refrigerant (either purge charge or final charge) is added to the system. This means that if a purge charge is used, the filter and dryer combination of the invention are provided in the liquid line before the system is evacuated and before the purge charge is introduced. The purge charge and entrained impurities are then removed from the system, the system evacuated again, a fresh charge of refrigerant introduced into the system, and the system sealed. Thus, in a more narrow embodiment the invention comprises the steps of:

(a) removing the refrigerant from the system;

(b) making the necessary repair;

(c) removing any dryer present in the liquid line;

(d) adding a chemical filter and a new dryer to the liquid line;

(e) evacuating the system after the chemical filter and new dryer have been added to the liquid line;

(f) adding a purge charge of fresh refrigerant to the evacuated system and circulating it throughout the system, and (h) sealing the system.

Although it is not essential, it is preferred in the practice of the invention that the chemical filter and dryer be placed in series in the liquid line, with the chemical filter typically placed in the liquid line upstream of the new dryer. It is further preferred that the chemical filter also be capable of filtering particulate matter. By chemical filter is meant a filter which is able to absorb or adsorb contaminants comprising chemical species other than the refrigerant and lubricant. Such contaminating chemical species can be formed in the system as a result of the system failure requiring the repair. Contaminating chemical species are formed by hydrolysis of the hygroscopic lubricant with moisture introduced into the system during a repair or leak. Other contaminants can be introduced during a repair as a consequence of exposure to the surrounding ambient, the use of dirty or otherwise contaminated equipment, refrigerant, etc. Contaminating species corrode and plug the system, particularly in the capillary tube. Activated alumina has been found to be useful as a chemical filter in the practice of the invention. A molecular sieve type of desiccant dryer has been found to be useful as a dryer in the practice of the invention.

The method of the invention is particularly useful for repairing the refrigeration systems in household refrigerators.

DETAILED DESCRITION

Figure 1B:
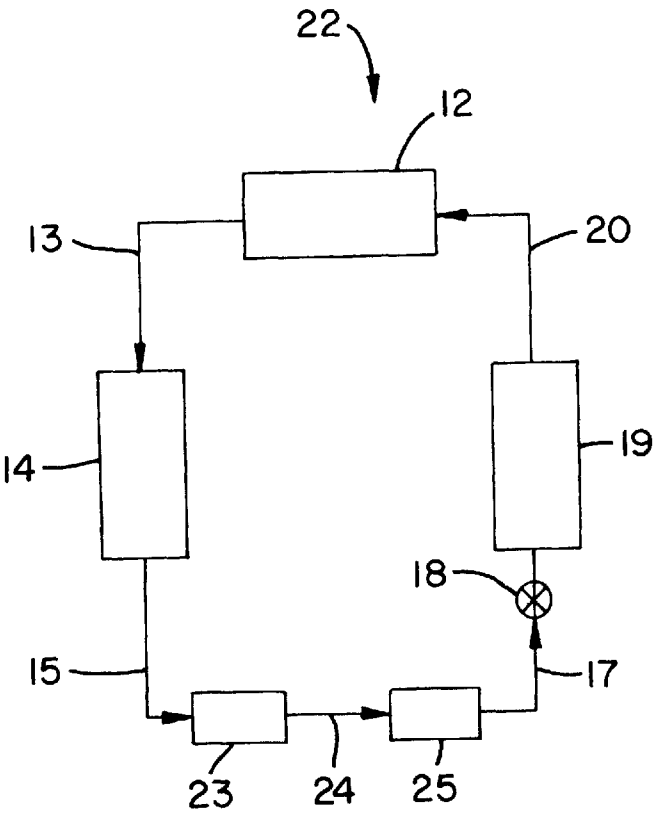
FIGS. 1(*a*) and 1(*b*) schematically show, in simple block diagram fashion, a refrigeration unit prior to being repaired and a refrigeration unit repaired according to the process of the invention, respectively.

As set forth above, the refrigerant used in and used for refrigerant replacement in the systems being repaired with the process of the invention are hydrofluorocarbons. Hydrofluorocarbons are chlorine-free compounds of hydrogen, fluorine and carbon and, as set forth above, illustrative, but nonlimiting examples of such compounds include one or more of $CH_3CHF_2$, $C_2HF_5$, $CH_2F_2$, $C_2H_3F_3$, $CHF_3$ and $C_2H_2F_4$ which are commonly known as R-152a, R-125, R-32, R-143a, R-23 and R-134a, respectively. R-134a, which is 1,1,1,2-tetrafluoroethane (R-134 is its symmetrical isomer 1,1,2,2-tetrafluoroethane), has been adopted for use by many major manufacturers of refrigeration equipment in the United States. The practice of the invention has been found useful for repairing refrigeration systems having R-134a as the refrigerant, which is removed and replaced in the practice of the invention. This refrigerant is not compatible or miscible with the mineral oil compressor lubricants used in the prior art refrigeration systems employing chlorine containing refrigerants. The lubricating oil must be miscible with the refrigerant over the operating temperature range of the system which is typically from about −20 to +150° F. Consequently, and as is known to those skilled in the art to which the invention pertains, synthetic lubricants have been developed as compressor lubricants for use in HFC systems, such as R-134a systems. These synthetic compressor lubricants comprise esters, are very hygroscopic and form organic acids when exposed to moisture. These acids are corrosive and can also block the capillary tube in the system. In one embodiment of the invention the refrigerant consists essentially of R-134a, or 1,1,1,2-tetrafluoroethane and a hygroscopic polyol ester lubricant. It should be noted that R-134a of itself absorbs moisture and it absorbs more moisture than the previously used and chlorine containing R-12.

Illustrative, but nonlimiting examples of hygroscopic, synthetic lubricants which have been found miscible with HFC refrigerants, including R-134a, include polyoxyalkylenes such as polyoxyalkylene glycols or PAG lubricants as they are known, and polyol esters. The polyol ester lubricants are esters of fatty acids with polyhydric alcohols and polyhydric polyethers. The fatty acids include straight and branched fatty acids having from 2–20 carbon atoms and also polybasic fatty acids having from 4 to 36 carbon atoms as is disclosed, for example, in U.S. Pat. Nos. 5,021,179 and 5,211,884 and in European patent publication EP O 406 479 A1, the disclosures of which are incorporated herein by reference. The polyol esters are reported to be less hygroscopic and have better electrically insulative properties than the PAG type. The polyol ester lubricants may be derived by esterifying, with one or more fatty acids, a polyhydric alcohol or polyhydric polyether such as neopentyl glycol or pentaerythritol (1), trimethylol propane (2), and di- and tripentaerythritol (3) represented by the formulae:

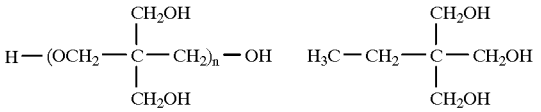

(1), (3) (2)

wherein the value of n is 1, 2, or 3, and also a polyvalent alcohol represented by the general formula:

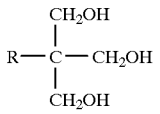

in which R is an alkyl group having not more than three carbon atoms and the fatty acid esterified with the alcohol is not more than 25 mole % of at least one polybasic fatty acid having from 4 to 36 carbon atoms.

As set forth above, it is essential to the practice of the invention in which the refrigeration system is opened to the atmosphere, that a combination of a chemical filter and a dryer be present in the liquid line before the system is recharged with fresh refrigerant. Refrigerant systems in household refrigerators invariably have a dryer present in the liquid line. As set forth above, if the system is fairly new and moisture hasn't entered the system prior to making the repair, it is possible to leave the old dryer in the line and to add the chemical filter or to leave the old dryer in the line and add a combination of a chemical filter and a new dryer to the liquid line. However, it is preferred in the practice of the invention that the dryer present in the liquid line before the repair was made be removed, discarded and replaced with a combination of a chemical filter and a new dryer. The new dryer is a desiccant dryer and preferably a molecular sieve desiccant dryer. A molecular sieve desiccant dryer which has been found to be useful in the practice of the invention comprises a product called XH-9 manufactured by UOP Molecular Sieves. A commercially available desiccant dryer containing beads of this molecular sieve is obtained from the Copper Products Division of the Parker Hannifin Corporation as their part number 032099-00 and is called a filter/dryer, because it contains a screen of approximately 120 to 200 mesh size for mechanically removing particulate matter. Thus, the use of the term "filter" in connection with this and other filter/dryers means a combination of mechanical, particulate filtration and desiccant drying, but not the chemical filtration which is essential to the practice of the invention.

Any repair which opens the hermetically sealed refrigeration system permits humid ambient air to enter the compressor and tubing after evacuation of the refrigerant charge when the system is opened. Even though most of the water or moisture will be removed by the desiccant dryer that is installed as part of the repair, some will remain dissolved in the hygroscopic lubricant and cause the formation of organic acids as the ester hydrolizes to the original acids and alcohols. Further, it is also possible that over a long period of time water in the dryer will desorb and hydrolyze the ester lubricant. Since moisture contamination cannot be completely avoided during field repairs, the method of the invention is useful for protecting the refrigerator from the effects of slow deleterious chemical reactions. It has been found that filter/dryers employing mechanical particulate filtration and desiccant drying means are not adequate to prevent fouling and plugging of the capillary tube in a refrigeration system employing an HFC refrigerant such as R-134a and a hygroscopic polyol ester lubricant. It was found that extremely fine material in the form of solids, sludges and gums passed through the particulate screens and built up deposits in the bores of the capillary tubes with a concomitant reduction in refrigerant flow and loss of refrigeration capacity in the refrigerator. In some cases the refrigerant flow was completely plugged and all refrigeration capability was lost. This phenomenon was not experienced with the formerly used CFC refrigerants such as R-12. Consequently, the use of a chemical filter as described above is essential to the practice of the invention. A chemical filter medium which has been found useful in the practice of the invention comprises activated alumina. It is preferred that the chemical filter also have mechanical filtration ability with openings on the order of, for example, from five to fifty (5 to 50) microns in diameter or effective diameter. If the activated alumina is in the form of a porous core, then the core will provide both the chemical and mechanical filtration capability. If the activated alumina is in the form of beads or pellets, such as Alcoa F200 or the refrigeration grade RF200, then the mechanical filtration capability is provided by a porous material made from glass frit, ceramic, plastic, etc. While the order of the chemical filter and dryer in the practice of the invention is not believed to be critical, it is preferred that the chemical filter and the dryer be in series and that the chemical filter be upstream of the dryer. This order will protect the molecular sieve desiccant material from degradation by any mineral acids that might be present in the system, because the chemical filter will sorb the acids before they can reach the dryer. A commercially available chemical filter useful in the practice of the invention is a Schrader Core activated alumina filter sold by Gemline as Part #3700-99010. It is also within the scope of the practice of the invention that the chemical filter and dryer be contained within the same housing. If desired the chemical filter and dryer may be in parallel, but it is believed that this will slow down the chemical filtration.

Figure 1A:
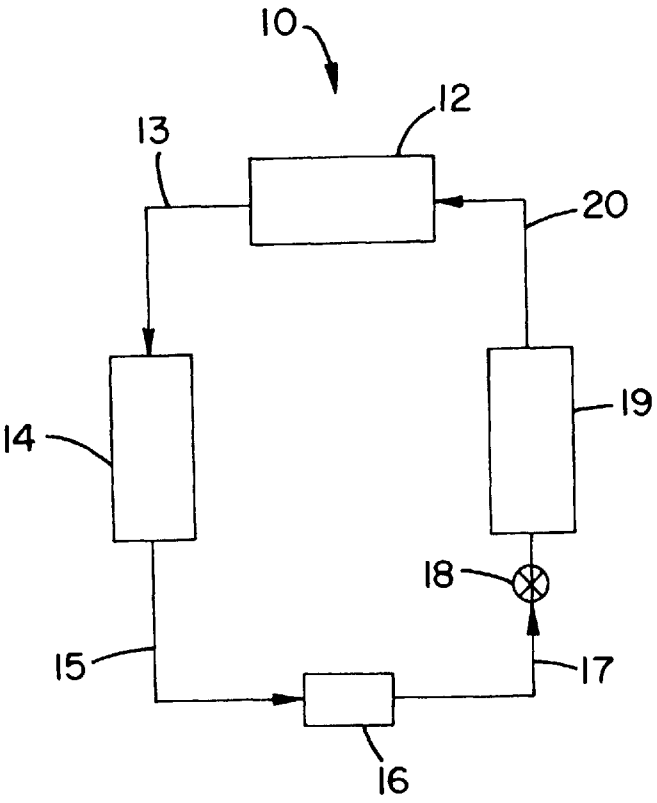
Fig. 1(a) (Prior Art)

Referring now to FIG. 1(*a*), there is schematically illustrated in simple block diagram form, a typical hermetically sealed refrigeration system 10 which includes a compressor and electric compressor motor combination 12 as a single unit which compresses the refrigerant and passes the compressed refrigerant via line 13 to condenser 14 in which the compressed refrigerant becomes liquid. The liquid refrigerant is then passed via liquid line 15, through filter/dryer 16 and liquid line 17 which contains a capillary tube as an expansion valve illustrated as valve 18, just upstream of evaporator 19. In the evaporator the liquid refrigerant evaporates and expands by absorbing its latent heat of evaporation and sensible heat of expansion to provide the cooling. Dryer 16 is present in the liquid line or lines 15 and 17 and contains a desiccant dryer, generally of the molecular sieve type. Dryer 16 typically also contains particulate filtering means and is therefore generally referred to in the art as a filter/dryer. It does not, however, contain means for absorbing or adsorbing chemical contaminants out of the system as the filter of the invention does. The refrigerant vapors pass from evaporator 19 to compressor 12 via line 20 to complete the cycle. The compressor unit 12 contains the lubricant, mainly in the compressor crankcase or sump (not shown), although some of the lubricant is entrained in the refrigerant and is circulated throughout the system. Dryer 20 is used in refrigeration systems in household refrigerators. In a similar fashion, FIG. 1(*b*) schematically illustrates a refrigeration system similar to that of FIG. 1(*a*) in all respects, except for the combination of the chemical filter 23 and the dryer 25 present in the liquid line or lines 15, 24 and 17. Thus, compressor and electric compressor motor combination 12 are a single unit and compress the refrigerant vapors which pass, via line 13 to condenser 14 in which the vapor is liquified. The liquid refrigerant is passed via line 15 to chemical filter 23, then to dryer 25 via line 24, and from there via line 17 and through capillary 18 into evaporator 19 in which the liquid refrigerant vaporizes and expands to provide the cooling. The expanded refrigerant vapors pass via line 20 back to compressor 12 and the cycle is repeated.

Line 17 includes a capillary tube shown as valve 18 which serves as an expansion valve just upstream of evaporator 19. The combination of chemical filter 23 and dryer 25 are added to the liquid line or lines 15,17 replacing filter/dryer 16 as part of the repair procedure and before fresh refrigerant is added to the repaired system.

Typical hermetically sealed refrigeration units as described herein and present in household refrigerators generally require servicing or replacement of the compressor after an extended period of time (i.e., ten or more years). However, it is also possible that other parts of the system may develop a leak or clog, thereby requiring repair to that part of the system. In order to repair a hermetically sealed refrigeration system, it is necessary to remove the old refrigerant and open the system to the atmosphere, albeit for as short a period of time as is necessary to avoid moisture buildup and concomitant acid formation due to hydrolysis of the hygroscopic lubricant. Other than replacement of the compressor, there are two types of repairs. They are commonly known as a high side repair and a low side repair, depending on which side of the compressor, upstream or downstream, the system needs repairing. The terms high and low refer to the refrigerant vapor pressure in the system, with the high side downstream of the compressor up to the evaporator being higher in pressure than the low side from the evaporator back to the compressor. A typical low side pressure is about four (4) inches of vacuum (30 inches equals one atmosphere), while the pressure in the high side at the condenser typically ranges between about 90 to 130 psig, depending on the ambient temperature. Leaks are detected using a halogen detector known as a Freon detector. This is an electronic leak detector and is readily available as is known to those skilled in the art. Soapy water or other materials must not be used in determining a leak in the practice of the invention as this may result in contamination of the system. Low side leaks are detected by turning the system (refrigerator) off and permitting the high and low side pressures to equalize, after which a Freon or halogen detector is used to locate the leak. In the case of a high side leak, an insignificant amount of moisture will enter the system as long as there is sufficient refrigerant present prior to the repair to maintain the high side pressure above atmospheric. On the other hand, if there is a low side leak, then a significant moisture may enter the system and if the leak is bad enough and has gone unrepaired long enough, the capillary tube may be plugged to such an extent that the system is not able to provide adequate refrigeration. The method of the invention is used to repair either a high side or low side leak and replacement of system parts such as the condenser, liquid line, etc. or a burned out compressor. A clogged capillary tube may require replacement of the capillary tube and the evaporator and, in some systems, the entire refrigerator.

In replacing a condenser or other parts or repairing a leak (all hereinafter "repair"), the refrigerant is removed and the system opened to the atmosphere for a time long enough to make the necessary repair. As stated above, because the compressor lubricant used with the HFC refrigerant is hygroscopic and forms organic acid by reacting with water, at least two major manufacturers of refrigeration systems and refrigerators have recommended that the system not be left open to the atmosphere for more than ten to fifteen (10 to 15) minutes. This is because the reaction products of the hygroscopic lubricant and the moisture can clog the capillary, thereby rendering the refrigeration unit inoperable.

In marked contrast to the recommendations of these refrigeration system and refrigerator manufacturers, using the process of the invention permits the system to be open to the atmosphere for an hour. In fact, studies made on typical household refrigerators using the R-134a HFC refrigerant and a hygroscopic, synthetic polyol ester compressor lubricant have shown that even after the refrigeration system has been left open to the atmosphere for twenty four (24) hours, using the method of the invention which includes adding a chemical filter and a desiccant dryer to the liquid line, resulted in the recharged resealed system operating normally even after two thousand (2,000) hours of continuous service despite having been open to the atmosphere for such a long period of time. These studies proved the efficacy of the invention in making repairs to household refrigerators using the R-134a HFC refrigerant and a hygroscopic, synthetic polyol ester compressor lubricant. However, in the context of the invention, it is preferred that the system not be left open to the atmosphere for a period of time longer than one hour in order to provide a large margin of safety, due to the vagaries and possible host of contaminants in the field. In these studies the chemical filter was an activated alumina filter and the dryer was a desiccant molecular sieve dryer. The chemical filter and the dryer were installed in series in the liquid line upstream of the capillary tube, with the chemical filter being upstream of the dryer. The actual units used were a Schrader Core activated alumina filter (Gemline Part #3700-99010) and a 134a Filter/Dryer available from GE Consumer Service as part number WR86X0096 which contains a molecular sieve desiccant known as XH-9. This activated alumina filter is a solid core activated alumina filter. It should be noted that at least one manufacturer of refrigeration systems recommends that solid core activated alumina filters not be used with a system employing the R-134a refrigerant and hygroscopic polyol ester lubricant. Thus, the method of the invention is believed to be unexpected and unobvious.

In making a repair to a refrigeration system according to the practice of the invention, the refrigerant is first removed from the system. This is accomplished by means of a typical refrigeration recovery unit which comprises a vacuum pump much like the compressor in the system, a container for the refrigerant removed from the system, hoses and piercing valves. The hoses are attached to the piercing valves with one valve at the high side (typically at the dryer) and the other valve on the suction or low side of the system which is usually at a processing tube on the compressor. The hoses run to the recovery pump which pulls the refrigerant out of the system or unit. After the refrigerant is removed, the hoses are removed and the system is opened to the atmosphere. After the system is opened to the atmosphere, the repair is made. This can be replacement of a compressor or other part. In the case of a compressor replacement, the new compressor comes as a sealed unit because it contains the hygroscopic lubricating oil used with the HFC refrigerant. It is important that the hermetic seal of the compressor unit not be opened until it is ready to be placed in the system. In the case of a pinhole leak, the leak is repaired by soldering or brazing. It is important that a flux not be used to avoid contaminating the system. Typically a Silfos braze is made on all pinhole leaks and repair connections that require brazing. The repair should be made within one hour after the refrigeration system is opened to the atmosphere. The new compressor should not be open to the atmosphere for more than an hour, due to the presence of the hygroscopic polyol ester lubricant in the compressor unit. The existing dryer in the liquid line is removed and discarded and the chemical filter and dryer combination of the invention is placed in the liquid line as part of the repair procedure. While it is believed that the order of the filter and dryer is not critical with respect to acid removal, it is preferred that the chemical filter be placed upstream of the dryer to avoid possible degradation of the desiccant drying material by any acid or other chemical species present in the system and also to avoid fouling or plugging of the dryer by particulate material, gum, sludge, etc. After the repair has been made and the filter dryer combination of the invention installed in the liquid line, the system is again evacuated using the recovery pump. Depending on whether or not air or other noncondensible gas has entered the system before or during the repair, either a purge charge or a final charge of fresh refrigerant is introduced into the system as explained more fully below.

If air has entered the system during the repair, it is preferred that a purge charge of fresh refrigerant be introduced and circulated in the repaired system to assist in sweeping and removing the air from the system before the final charge of fresh refrigerant is introduced and the system sealed. The purge charge of fresh refrigerant is introduced into the system either through a process port on the compressor if there is one, or through a piercing valve or other suitable means in the system on the high side of the compressor. The compressor is then turned on so that the purge charge of refrigerant circulates throughout the system, typically for about five minutes, and then withdrawn along with the entrained air and/or other noncondensible gas using the recovery unit. After the purge charge is removed, the system is again evacuated using the recovery unit typically to a 20 inch minimum vacuum. The final charge of fresh refrigerant is then introduced into the system and the system sealed, thereby completing the repair procedure. A sufficient amount of excess (i.e., one half ounce) refrigerant is recommended due to the presence in the system of the filter and dryer combination of the invention.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all the features of patentable novelty which reside in the present invention, including all the features and embodiments which would be treated as equivalents thereof by those skilled in the art to which the invention pertains.

What is claimed is:

1. A method of making a repair to a sealed refrigeration system having a hydrofluorocarbon refrigerant and a hygroscopic compressor lubricant, said method comprising the steps of:

(a) removing said refrigerant;

(b) making said repair;

(c) connecting a combination of a core-type activated alumina filter and a separate molecular sieve desiccant dryer in the liquid line of said refrigeration system;

(d) removing air from said system and recharging said system with fresh hydrofluorocarbon; and (e) resealing said system.

2. A method according to claim 1 wherein said refrigerant does not contain any chlorine.

3. A method according to claim 2 wherein said lubricant reacts with water to form products deleterious to said system.

4. A method according to claim 3 wherein said lubricant comprises a polyol ester.

5. A method according to claim 4 wherein said refrigerant comprises R-134a.

6. A method according to claim 5 wherein said desiccant comprises a molecular sieve.

7. A method according to claim 6 wherein said filter and said dryer are in series.

8. A method according to claim 7 for repairing the refrigeration system of a refrigerator.

9. A method of making a repair to a sealed refrigeration system in a refrigerator having a compressor, a condenser, an evaporator, a liquid refrigerant line including a capillary tube between said condenser and said evaporator, and a desiccant dryer in said liquid line upstream of said capillary tube, and wherein said system contains (i) a hygroscopic compressor lubricant which reacts with moisture to form products deleterious to said system and (ii) a refrigerant consisting essentially of a hydrofluorocarbon (HFC), said method comprising the steps of:

(a) removing said refrigerant from said system;

(b) making said repair;

(c) connecting a combination of a core-type activated alumina filter and a separate molecular sieve desiccant dryer in said liquid line; and (d) introducing a charge of fresh HFC refrigerant into said system and resealing said system.

10. A method according to claim 9 wherein said system is opened to the atmosphere and wherein said repair is made and said system resealed within one hour after said system has been opened to the atmosphere.

11. A method according to claim 10 wherein said dryer present in said liquid line is replaced by said combination of chemical filter and molecular sieve dryer.

12. A method according to claim 9 wherein a fresh charge of said HFC refrigerant is added to said system as a purge charge and circulated in said system after said repair is made and before said system is resealed.

13. A method according to claim 12 wherein said purge charge and any air present in said system is removed from said system, a fresh charge of said HFC refrigerant introduced into said system, and said system resealed.

14. A method according to claim 13 wherein said chemical filter is upstream of said molecular sieve dryer.

15. A method according to claim 14 wherein said refrigerant consists essentially of R-134a.

16. A method according to claim 15 wherein said lubricant comprises a polyol ester.

17. A method according to claim 16 wherein said system is opened to the atmosphere and wherein said repair is made and said system resealed within one hour after said system has been opened to the atmosphere.

18. A method according to claim 17 wherein said chemical filter includes mechanical filtration means.

* * * * *